US010935355B2

(12) United States Patent
Brydges-Price

(10) Patent No.: US 10,935,355 B2
(45) Date of Patent: Mar. 2, 2021

(54) PROJECTILE WITH NOSE PORTION COMPRISING A GAS BAG EXPANDING ON IMPACT TO RETARD THE VELOCITY

(71) Applicant: Richard Ian Brydges-Price, Angus Tayside (GB)

(72) Inventor: Richard Ian Brydges-Price, Angus Tayside (GB)

( * ) Notice: Subject to any disclaimer, the term of this patent is extended or adjusted under 35 U.S.C. 154(b) by 0 days.

(21) Appl. No.: 16/324,484

(22) PCT Filed: Aug. 8, 2017

(86) PCT No.: PCT/GB2017/052338
§ 371 (c)(1),
(2) Date: Feb. 8, 2019

(87) PCT Pub. No.: WO2018/029465
PCT Pub. Date: Feb. 15, 2018

(65) Prior Publication Data

US 2019/0178617 A1 Jun. 13, 2019

(30) Foreign Application Priority Data

Aug. 9, 2016 (GB) ..... 1613707

(51) Int. Cl.
*F42B 12/54* (2006.01)
*F42B 12/34* (2006.01)
(Continued)

(52) U.S. Cl.
CPC ..... *F42B 12/54* (2013.01); *F41H 13/0031* (2013.01); *F42B 12/34* (2013.01);
(Continued)

(58) Field of Classification Search
CPC ..... F42B 12/54; F42B 12/36; F42B 12/362; F42B 12/34
(Continued)

(56) References Cited

U.S. PATENT DOCUMENTS 2,617,359 A * 11/1952 Van Horn ..... F42B 12/54 102/512
3,386,381 A * 6/1968 Ferb ..... F42B 12/54 102/512
(Continued)

FOREIGN PATENT DOCUMENTS

EP 1 307 700 B1 4/2006
EP 1307700 B1 * 4/2006 ..... F42B 12/34
(Continued)

OTHER PUBLICATIONS

International Search Report and Written Opinion dated Jan. 19, 2018, issued in PCT Application No. PCT/GB2017/052338, filed Aug. 8, 2017.

*Primary Examiner* — Jonathan C Weber
(74) *Attorney, Agent, or Firm* — Workman Nydegger

(57) ABSTRACT

A projectile includes a bag of gaseous medium to effectively retard the velocity thereof on impact with a target in such a way as to prevent excess damage, injury or penetration, wherein the bag is configured to increase in area at the nose of the projectile following impact with a target, wherein the projectile includes a needle for penetrating a target and a cap which encloses the bag and includes a flat forward-most surface.

29 Claims, 9 Drawing Sheets

(51) Int. Cl.

| | |
|---|---|
| ***F42C 13/00*** | (2006.01) |
| ***F41H 13/00*** | (2006.01) |
| ***F42C 1/00*** | (2006.01) |
| ***F42B 12/36*** | (2006.01) |
| ***F42C 15/24*** | (2006.01) |
| ***F42B 12/76*** | (2006.01) |

(52) U.S. Cl.
CPC ..... *F42B 12/367* (2013.01); *F42B 12/76* (2013.01); *F42C 1/00* (2013.01); *F42C 13/00* (2013.01); *F42C 15/24* (2013.01)

(58) Field of Classification Search
USPC ..... 102/502, 512, 501; 604/130, 137; 473/581
See application file for complete search history.

(56) References Cited

U.S. PATENT DOCUMENTS

| | | | | |
|---|---|---|---|---|
| 3,820,465 | A * | 6/1974 | Delphia ..... | F42B 12/54 102/512 |
| 6,807,908 | B2 * | 10/2004 | Brydges-Price ..... | F42B 12/54 102/451 |
| 2004/0089186 | A1 * | 5/2004 | Brygdes-Price ..... | F42B 12/54 102/502 |

FOREIGN PATENT DOCUMENTS

| | | | |
|---|---|---|---|
| GB | 2 350 414 | A | 11/2000 |
| WO | 2000/71967 | A1 | 11/2000 |
| WO | 2004/010073 | A1 | 1/2004 |

* cited by examiner

PROJECTILE WITH NOSE PORTION COMPRISING A GAS BAG EXPANDING ON IMPACT TO RETARD THE VELOCITY

FIELD OF THE INVENTION

The invention relates generally to a projectile for use as a delivery system, particularly for applications including delivering a tranquillising substance, drug, vaccine, medication, identification means or tracking device to an animal or to any other target.

The device may also be used to take a sample of tissue. Such projectiles are commonly referred to as darts and their primary purpose is to provide means for remotely delivering and injecting a medication into an animal without causing undue harm or stress.

BACKGROUND TO THE INVENTION

There has long been a need to capture, study, relocate or medicate animals and various means are used.

The most commonly used method being by means of some form of adapted syringe containing a tranquilliser which is propelled and injected on impact into the animal. These tranquilliser dart devices have serious disadvantages primarily being lack of range and accuracy due to poor ballistic properties and the highly parabolic trajectory making range estimation critical. As a projectile the devices are inherently unstable due to length and weight. The projectile is also susceptible to spin which detrimentally affects the accuracy. The prior art has generally required low velocity to avoid deep penetration.

The known devices are also complex to assemble and load often with highly toxic drugs and are heavy in relation to the delivered payload.

It is one object of this invention to provide a tranquilliser or other medication delivery system using a projectile, being preferably spin stabilised having improved range and accuracy and of an inherently stable ballistic shape, being an improvement of the projectile described and claimed in WO 00/71967A1 and GB2350414 A1.

Another alternative object is to provide a projectile which has a more highly controlled penetration into a target.

Yet a further alternative object is to provide a projectile which itself does not include an explosive or gas producing charge.

A further alternative object of this invention is to provide a projectile which may be fired with accuracy at a soft target directly and even at close ranges and which is designed not to penetrate to any significant extent and which should only cause minimal injury to the limbs or torso whilst maintaining the adequate stability whilst in-flight to allow for a good accuracy and aim.

Another alternative object is to provide a projectile which is capable of marking the target for subsequent identification.

SUMMARY OF THE INVENTION

In accordance with a first independent aspect of this invention, there is provided a projectile including a bag of gaseous medium to effectively retard the velocity thereof on impact with a target in such a way as to prevent excess damage, injury or penetration, wherein said bag is configured to increase in area at the nose of the projectile following impact with a target, wherein said projectile comprises a needle for penetrating a target and a cap which encloses said bag and includes a flat forward-most surface.

This configuration is particularly advantageous because it allows the needle to penetrate the target whilst the projectile itself causes minimal tissue damage or muscle damage to the target. The cap may be configured to constrain the bag of gaseous medium sufficiently to improve the stability of the projectile in-flight after it has been launched. The flat forward most surface is advantageous because it prevents the bag from being excessively deformed whilst in flight which therefore further increases the stability of the flight for improved accuracy of the projectile. In a preferred embodiment, the cap further comprises a sharp 90 degrees edge between the flat forward most surface and the side surface of the cap.

Preferably, said cap is cylindrical with a flat forward-most surface with a single central aperture through which said needle extends.

This configuration is particularly advantageous because it allows the needle to enter the target sufficiently to a predetermined amount to inject in certain embodiments adequate amounts of the necessary substance. The single central aperture ensures the cap remains central to the projectile and needle and therefore ensures the projectile is stabilised whilst in-flight to ensure accuracy and aim. The cap also acts to protect the bag, during launch, from slumping and expanding causing inconsistent juddering and unpredictable exit points of the projectile. Additionally the cap protects from exposure to the frontal wind effect which would cause deformation due to violent buffeting of the air. In this manner accuracy is greatly improved.

Further preferably, said cap is formed of a single piece of readily shatterable plastics material.

This is a particularly advantageous configuration because it simplifies the manufacturing process by only a single piece sheet of material being needed. The readily shatterable plastic ensures the cap will shatter and be discarded on impact with the target, allowing the air bag to act to decrease acceleration and prevent harm and injury to an animal by excessive penetration. Furthermore, the bag remains covered during flight to increase stability and accuracy.

Preferably, the bag is substantially spherical before impact with a target. This configuration is particularly advantageous because it prevents the bag from being deformed to a large extent to a disproportionate shape in flight and therefore increases the stability of the projectile whilst in flight which increases the accuracy and aim of the projectile.

Preferably, the projectile further comprises a casing which contains a payload; the needle defining a channel for the payload to exit the casing; the needle being releasably mounted to the casing.

This configuration is particularly advantageous because it provides a simple and efficient mechanism for a medical substance or otherwise to be delivered to the animal though the needle. The releasable needle is advantageous because it allows the projectile to be collected and re-used with another needle and also allows for a range of different needles to be used on the same projectile if necessary.

Preferably, the needle incorporates a disc which sits against the forward-most surface of the casing when the needle is attached to the casing.

This configuration is particularly advantageous because the addition of the disc increases the weight at the front of the projectile which improves the transport, stabilisation and in-flight accuracy of the projectile.

Preferably, the cap is secured with an interference fit to the perimeter of the disc.

This configuration is particularly advantageous because it ensures the cap does not need to interfere with the casing itself, instead connecting with the disc and this therefore significantly improves the transport and stabilisation and in-flight accuracy of the projectile.

Preferably, the bag is secured between the disc and a retention cuff.

This configuration is particularly advantageous because it means that the bag is flattened between the disc and the target when it hits the target and ensures the bag acts to increase the surface area at the point of impact to spread and dissipate the kinetic energy over a large area.

Preferably, the needle comprises a conical tip which has itself no aperture.

This configuration is particularly advantageous because a conical tip increases the capability and efficiency of the penetration of the needle into the target by providing a sharp point to lead the insertion. The lack of aperture in the tip itself increases the inflight-stability because air is not entering the tip.

Preferably, the needle comprises one or more lateral apertures.

This configuration is particularly advantageous because it negates the need for an aperture to be in the tip of the needle and therefore increases the stability of the projectile in-flight. The lateral apertures are also advantageous because they provide an improved means to deliver the substance into the target as well as improve the distribution, and there can be more than one aperture which increases the speed of the delivery which would be necessary for delivery of this type where there is limited time for delivery before the needle will retract from the animal.

Preferably, the needle protrudes beyond the cap to a length greater than the length of the cap.

This advantageously allows for the needle to penetrate the target sufficiently to a pre-determined amount to deliver the required substance. This configuration also ensures that the projectile is weighted centrally to ensure maximum stability and accuracy in-flight.

Preferably, the needle comprises a cuff with one or more laterally extending members for retaining the needle in the target.

This configuration is particularly advantageous because it allows the needle to remain in the target for a sufficient amount of time to allow for maximum delivery of the substance and prevents a situation in which the needle would retract from the target due to the force of the impact.

Preferably, the cuff is dissolvable sub-cutaneously or intra-muscularly. This configuration is particularly advantageous because it allows the cuff to dissolve completely into the tissue or muscle of the animal so that there is no need for removal or collection and no possibility of the cuff causing damage or harm to the animal target if not removed in an adequate amount of time. For instance, if a non-dissolvable cuff remained inserted in the animal for too long a length of time it could cause infection and harm.

Preferably, the bag forms a cavity which contains air; wherein said air is substantially retained in the cavity after impact. This configuration is particularly advantageous because it allows the entire projectile including the bag to be reused as the bag remains a fully formed part of the projectile and is not destroyed on impact for instance by being overly expanded. The air within the cavity will act as an effective means to retard the velocity of the projectile by increasing the area at the nose thus spreading and dissipating the kinetic energy.

Preferably, the bag is configured to expand following impact with a target. This configuration is particularly advantageous because this provides an efficient way to rapidly increase the area at the nose of the projectile only on impact with the target which helps to prevent excessive injury or penetration to the target but ensures the projectile is not hindered by the increased area during flight.

Preferably, said expansion is effected by means of a pressurised medium stored in the projectile. This configuration is particularly advantageous because the same charge may also serve the purpose of driving a piston to inject the drug so this reduces the amount of components required in the projectile.

Preferably, a duct is provided between the bag and a cylinder of the casing whereby pressurised gas applies pressure onto a piston in order to assist in the delivery of a payload.

This configuration is particularly advantageous because it reduces the number of components required within the projectile as the same charge to expand the air bag on impact can be connected to the casing via the duct to enable delivery of the payload.

Preferably, the projectile further comprises a compound which includes an anaesthetic composition. This configuration is particularly advantageous because it provides a humane way to inject an animal with the necessary drug by numbing the area first and reducing the amount of pain felt by the animal during delivery of the payload. The inclusion within the projectile prevents the need for a separate projectile to be fired additionally to provide this anaesthetic.

Further preferably, the anaesthetic composition is provided between said cap and said bag. This configuration is particularly advantageous because the anaesthetic is in a convenient location to be delivered to the target prior to the substance within the cavity of the projectile and keeps the weight of the projectile loaded to the front to increase stability and accuracy.

Preferably, said needle is dissolvable sub-cutaneously or intra-muscularly. This configuration is particularly advantageous because it allows the implant to completely dissolve away into an animal tissue and muscle after penetration after it has received the benefits of the payload. There would be no need for a separate cavity or container for the payload within the projectile and hence the projectile itself would have improved accuracy and stability as there would be no inner liquid.

Alternatively, the needle contains a payload. This configuration is advantageous because it would negate the need for a separate cavity or container within the projectile to carry the payload (liquid or solid payload may be envisaged) and allow the needle itself to deliver the payload to the animal. This would improve the stability and accuracy of the projectile.

In further subsidiary aspect, the bag comprises a rod which is displaceable by a threaded engagement towards a detonator dependent upon the extent of rotation which the projectile undergoes during rifling spin. This allows the rod to detonate dependent upon the extent of rotation during rifling spin. In one embodiment, when at close range, the rod fires the detonator to expand the bag and when at long range the rod unthreads to neutralise the detonator and its bag.

Optionally, the rod unwinds in the direction opposite to the rifling spin.

Optionally, the rod unwinds in the direction of the rifling spin.

In a further subsidiary aspect, the rod is attached to two weighted portions which are separated in the lateral direction by a spacing.

In a further subsidiary aspect, the projectile comprises a storage of electrical charge and one or more electrical probes which are configured to discharge said charge in said target.

In a further subsidiary aspect, the electrical probes are secured to the outside wall of the projectile during flight and the bag causes the electrical probes to displace towards the target on impact.

In a further subsidiary aspect, the projectile further comprises a shaft which secures an impact detonator in a forward position.

In a further subsidiary aspect, the projectile further comprises a casing and one or more conductors extending between a capacitor located in the casing of the projectile and said electrical probes.

In a further subsidiary aspect, the electrical probes comprise a distal extremity which is barbed.

In a further broad aspect, the projectile includes a bag of gaseous medium to effectively retard the velocity thereof on impact with a target in such a way as to prevent excess damage, injury or penetration, said projectile having a forward-facing nose portion and a rear-facing portion wherein said bag is configured to increase in area at the nose portion of the projectile following impact with a target, wherein said projectile comprises a storage of electrical charge and one or more electrical probes which are configured to discharge said charge in said target.

In a subsidiary aspect, the electrical probes are secured to the outside wall of said projectile during flight and said bag causes said electrical probes to displace towards said target on impact.

In a further subsidiary aspect, the projectile further comprises a shaft which secures an impact detonator in a forward position.

In a further subsidiary aspect, the projectile further comprises a casing and one or more conductors between a capacitor located in the casing of the projectile and said electrical probes.

In a further subsidiary aspect, the electrical probes comprise a distal extremity which is barbed.

BRIEF DESCRIPTION OF THE FIGURES

Embodiments of the invention will now be described, by way of example only, and with reference to the accompanying drawings, in which.

DETAILED DESCRIPTION OF THE INVENTION

Figure 1:
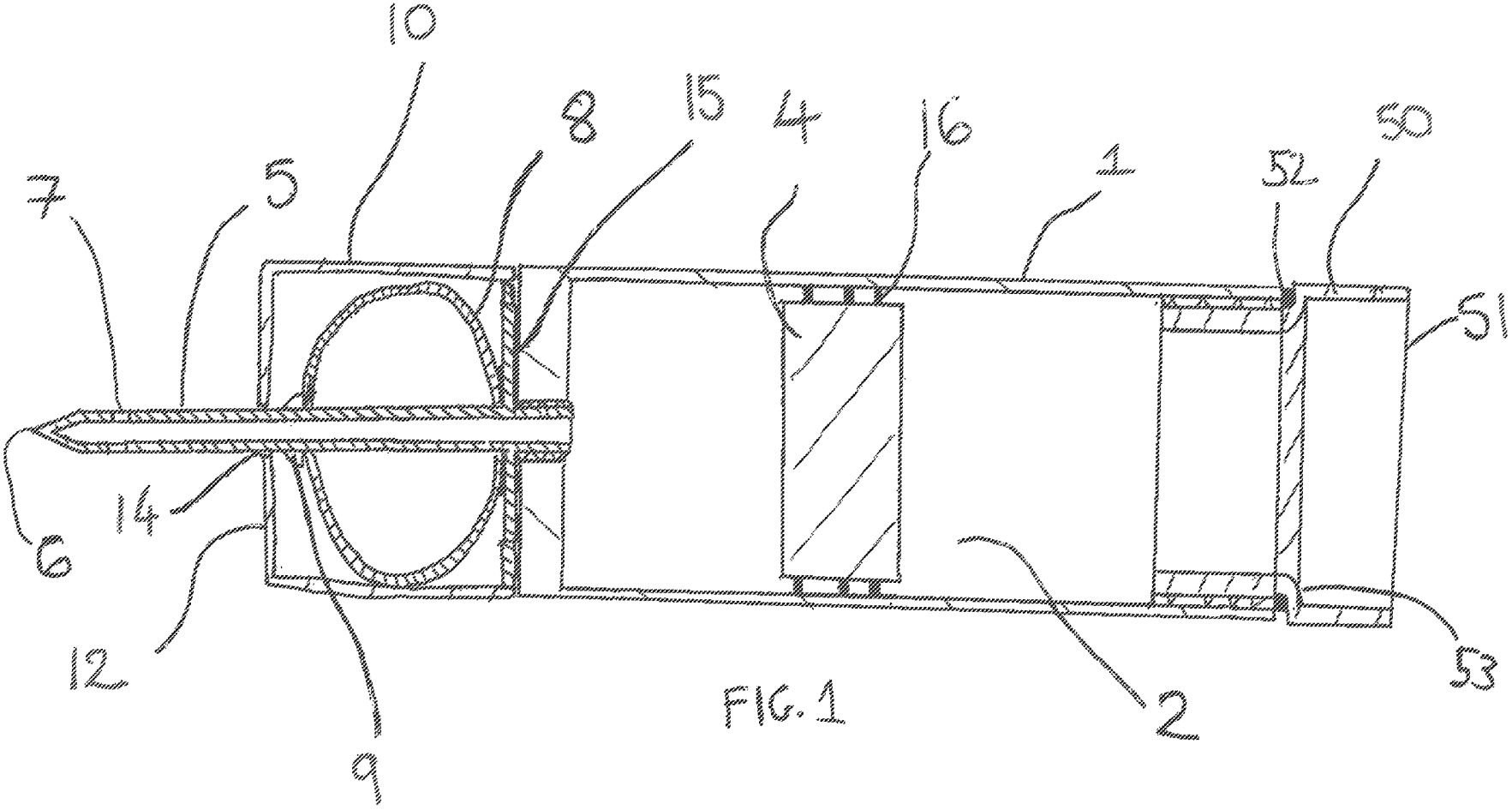
FIG. 1 is a cross-sectional view of the projectile along its length.

As shown in FIG. 1, a projectile has an outer casing 1 surrounding a compartment 2 to contain a substance to be injected, in particular, into an animal. Generally, the substance is a tranquiliser or medication but any suitable fluid substance may be contained including a tracking fluid, dye, medical vaccination or medication. Within the compartment 2 is a piston 4 which serves to drive the substance forward through a hollow needle 5 and out through lateral apertures 7 within the needle 5, once the needle has penetrated the surface of the skin of an animal and is inserted intramuscularly. The needle 5 has a conical tip 6. The needle 5 projects forwards through a cylindrical nose cap 10. The delivery end of the needle 5 projects beyond the forward-most surface 12 of the nose cap 10. In a preferred embodiment, the needle is releasably mounted on the surface of the outer casing. This allows for the projectile to be used with a range of different needles 5 on the same kind of casing. The piston incorporates one or more peripheral annular seals to seal the portion of the cylinder above and below the piston. In a preferred embodiment, there are two or three annular seals of this kind. In a preferred embodiment, the piston 4 is of relatively lightweight material when compared to the material employed for the needle or even when compared to the material employed for the casing. In other words, the piston has a low density compared to the density of the needle or even compared to the density of the material employed for the casing. The plunger may advantageously be equipped with one or more annular diaphragms located between a central portion of the plunger and the casing. This may serve to create a sufficiently liquid tight seal whilst at the same time lowering the weight of the plunger.

The lateral apertures 7 are located at opposite sides of the needle 5 towards the conical tip 6. The conical tip terminates in the forward most portion with a pointed tip. The lateral apertures 7 in the needle 5 ensure efficient and fast delivery of the substance to an animal. The lateral apertures 7 also act to increase the stabilisation of the projectile during the flight as there is no aperture in the conical tip itself.

Surrounding a lower portion of the needle 5 is an expandable bag 8, substantially spherical in shape and containing a gaseous medium. The bag 8 is expandable and in a preferred embodiment, gas for inflating the bag 8 is derived from a detonator with a gas producing charge. In alternative embodiments, the gas may be derived from gas stored in the container or from the gases produced from the propulsive charge on firing the projectile.

In an embodiment, the bag 8 contains only air which dramatically increases in volume due to the heat of impact. Alternatively, the bag 8 may be filled with a gas which on impact is sufficiently pressurised to cause the ignition of a fuel. In other words, the bag 8 may be configured to ignite as diesel would in the internal combustion chamber of a diesel engine. In a further embodiment, a detonator may be employed to cause the expansion of the bag and its gaseous contents. In a further embodiment, electrical probes may be provided. These may be hinged relative to the projectile to for example expand sideways on impact. These electrical probes may be employed to trigger an ignition of a combustible gas provided in the bag 8 to cause its expansion. In a preferred embodiment, the pressure in the bag can be transferred to a pressure behind the plunger to cause a payload provided in front of the plunger to exit through the needle into a target.

In a further embodiment, the airbag gas pressure can be made to push the injection plunger down the injection needle running to the base of the projectile with injection ports at its base, forcing the payload into the base of the needle to be injected forward. This would provide a moment of "weightlessness" as both the plunger and payload move away from the target on impact.

In a preferred embodiment, the bag 8 is of a rubber material or the like including Kevlar, latex or silicone and is capable or expanding or inflating in the manner of a balloon. At the front end of the bag 8 is an end plug 9 which supports the contact with the needle 5. In use, the expandable bag 8 of gaseous medium acts to effectively retard the velocity of the projectile on impact with a target in such a way as to prevent excess damage, injury or penetration to the animal as it acts to rapidly increase the area at the nose of the projectile following impact with a target thus spreading and dissipating the kinetic energy over a large area. In a preferred embodiment, the gas remains in the bag after impact with the target.

In the preferred embodiment, the bag 8 expands due to the gas pressure which is actuated by a sensor on initial impact or using a proximity sensing means located within the projectile. In this embodiment, there may be ports at the base which are exposed to the propulsive gases during the flight of the projectile with intervening valve means (not shown) to retain the gas pressure. In an alternative embodiment physical displacement actuates a valve device (not shown) which pressure inflates the bag 8.

In an alternative embodiment, the gas pressure is stored in the projectile and preferably derived from the propulsive charge gases occurring on firing the projectile which also act to drive the piston forwards to force the substance into the needle for delivery (see below and FIG. 4).

In a preferred embodiment, the bag 8 is secured between a disc 15 and a retention cuff 9. In a preferred embodiment, the retention cuff 9 acts with an umbrella mechanism to secure the needle to the target after penetration to prevent a retraction of the needle and therefore ensuring the needle remains inserted for a sufficient amount of time to allow sufficient delivery of the payload.

The cylindrical nose cap 10 surrounds the entire bag 8 and part of the needle 5 and fits closely around the outer most sides of the bag 8. The cap 10 has a flat forward-most surface 12 and is preferably of a readily frangible and shatterable plastics material. The cap is relatively shatterable when compared particularly to the casing of the projectile. Indeed, it possess a much higher degree of brittleness than the casing in order to allow the expansion of the airbag on impact. In certain embodiments, the longitudinal wall of the cap is no more than 1 millimetre and of a polymeric material which fractures on buckling when compressed by less than 10% of its initial length, less than 7% of its initial length, less than 5% of its initial length, or less than 2% of its initial length.

In the preferred embodiment the cap 10 comprises a single piece of material with no specific structural lines of weakness but instead a fully shatterable material. The flat forward most surface 12 serves the purpose of allowing a maximum length of insertion of the needle 5. The forward most surface 12 of the cap 10 includes a central aperture 14 through which the needle 5 extends. Preferably, the forward surface 12 meets the sides of the cap 10 at a sharp edge of 90° to provide the greatest accuracy.

In use, the nose cap 10 acts to greatly increase the accuracy of the projectile by protecting the bag 8 during launch from the massive rotational forces. At launch, the bag 8 slumps against violent acceleration of the gas pressure and is spun out by centrifugal force. Without the cap 10, the bag 8 would slump and expand and judder whilst being driven down the barrel. The juddering would not be consistent causing the projectile to exit at different points in its oscillations which are caused by the propellant explosion at the breech. The unpredictable exit point would decrease the accuracy dramatically.

During flight, the cap 10 also protects the aerodynamics of the projectile 1 from the frontal wind effect. Without the cap 10, the bag 8 would be deformed by violent buffeting of the air which would significantly affect accuracy. Therefore, the cap 10 of the described configured greatly improves accuracy.

The cap 10 secures to a disc 15 which is attached to the forward surface of the outer casing 1. The disc 15 has an outer perimeter. Preferably, the cap 10 is secured to the disc 15 at its outer perimeter with an interference fit. This ensures that the cap does not interfere with the casing 2 and have any effect on the stability of the projectile during flight. The disc 15 screws into the forward-most face of the outer casing 1 (see FIG. 3).

In preferred embodiments, both the needle and the disc are formed as a single piece of material. In a further preferred embodiment, the material is a metal.

The rear end of the casing 1 is capped off by a tail piece 50. The tail piece 50 comprises a removable plug 51 to permit filling of the cavity 2. The casing may be provided with a threaded section to allow the tail piece to be secured to the casing by screwing. The tail piece may also provide a water tight attachment between the tail piece and the casing. An O-ring 52 or other sealing means are also provided to seal off the rear portion of the threaded section. The tail piece also incorporates an inner flange 53 with a rounded profile.

The projectile is adapted to be fired from a barrel weapon (not shown) which may be rifled to impart spin. The projectile may be of sub-calibre design using a discarding sabot and be fired in a barrel having progressive rifled pitch to attain a velocity greater than 500 m/s. The projectile may have a mass of about 8 to 10 grams and be some 1.5 cm in calibre.

In use, the projectile is fired from a weapon and gas pressure from the propulsive charge will be about 600 atmospheres, sufficient to allow pressure gas to enter via orifices to the reservoir space behind piston 4. Once the projectile leaves the muzzle of the weapon, internal pressure in the reservoir forces closure of the orifices.

Preferably, the expandable bag 8 is subject to the pressurised medium through means actuated on impact with a target, for example by an impact sensor or by means of a proximity sensing means, or by physical displacement actuating a valve device. The pressure, preferably being gas pressure, stored in the projectile and preferably derived from the propulsive charge gases occurring on firing the projectile from a weapon is used, in use, to rapidly expand the bag 8 and act to spread the impact over a wide area, slowing velocity and preventing excess penetration of the needle 5.

Figure 2:
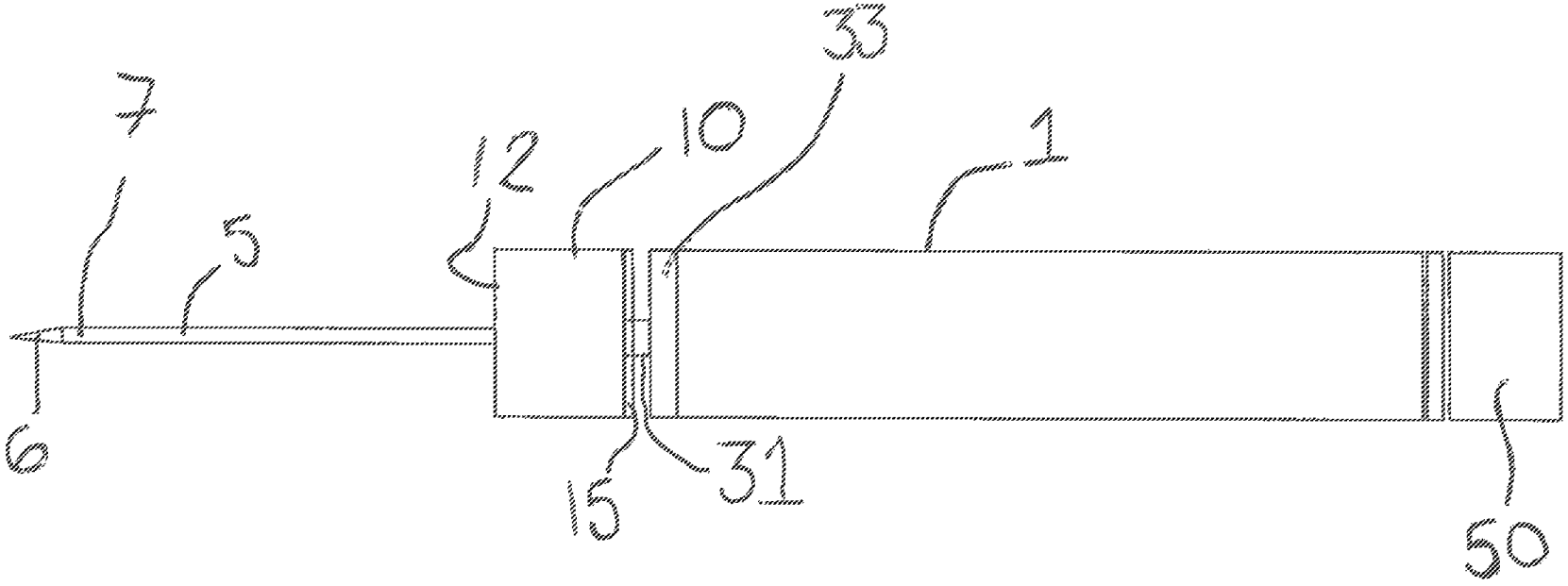
FIG. 2 is a side view of the projectile.

FIG. 2 shows a side view of the outline of the projectile. This view shows how the needle 5 extends beyond the forward-most flat surface 12 of the cap 10 to a length greater than the length of the cap 10 itself. FIG. 2 also shows the relative positions of the disc 15 cap 10 and outer casing 1.

Figure 3:
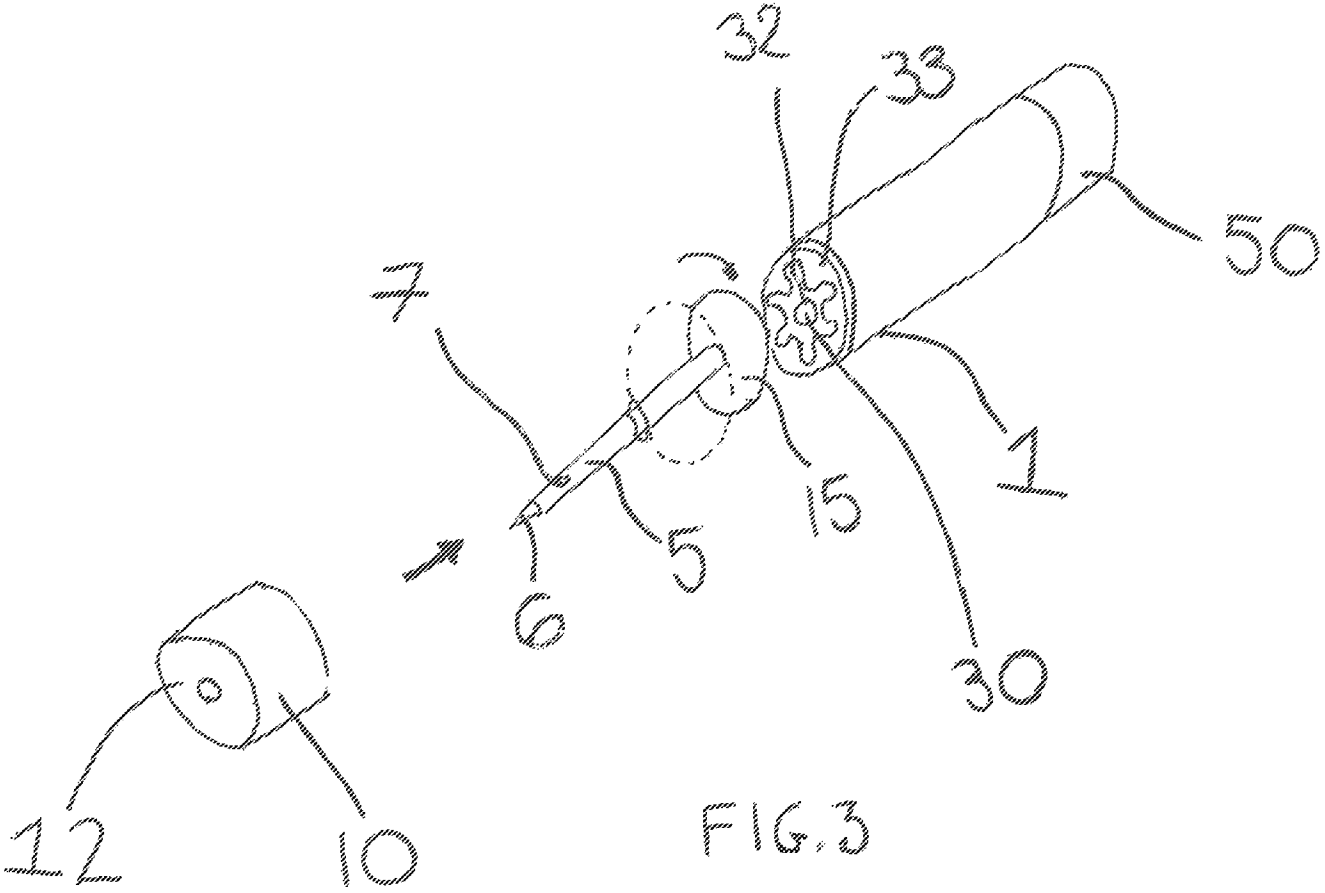
FIG. 3 is a perspective view of the projectile.

FIG. 3 shows how the cap 10 slots onto the outer perimeter of the disc 15, surrounding the bag 8 (not shown). FIG. 3 shows the components of the projectile more clearly. On the forward most face 12 of the outer casing 1 is a central threaded aperture 30 into which a central threaded projecting portion 31 extends from the underneath side of the disc 15 to act to secure the disc 15 and attached needle 5 to the outer casing 1. Surrounding the forward most face of the outer casing 1 is a raised portion 32 having a cogwheel type pattern. An outer template 33 matching the cogwheel pattern, slots around the raised portion 32 to form flat forward most surface 12 of the outer casing 1 to engage with the underside of the disc 15.

Figure 4:
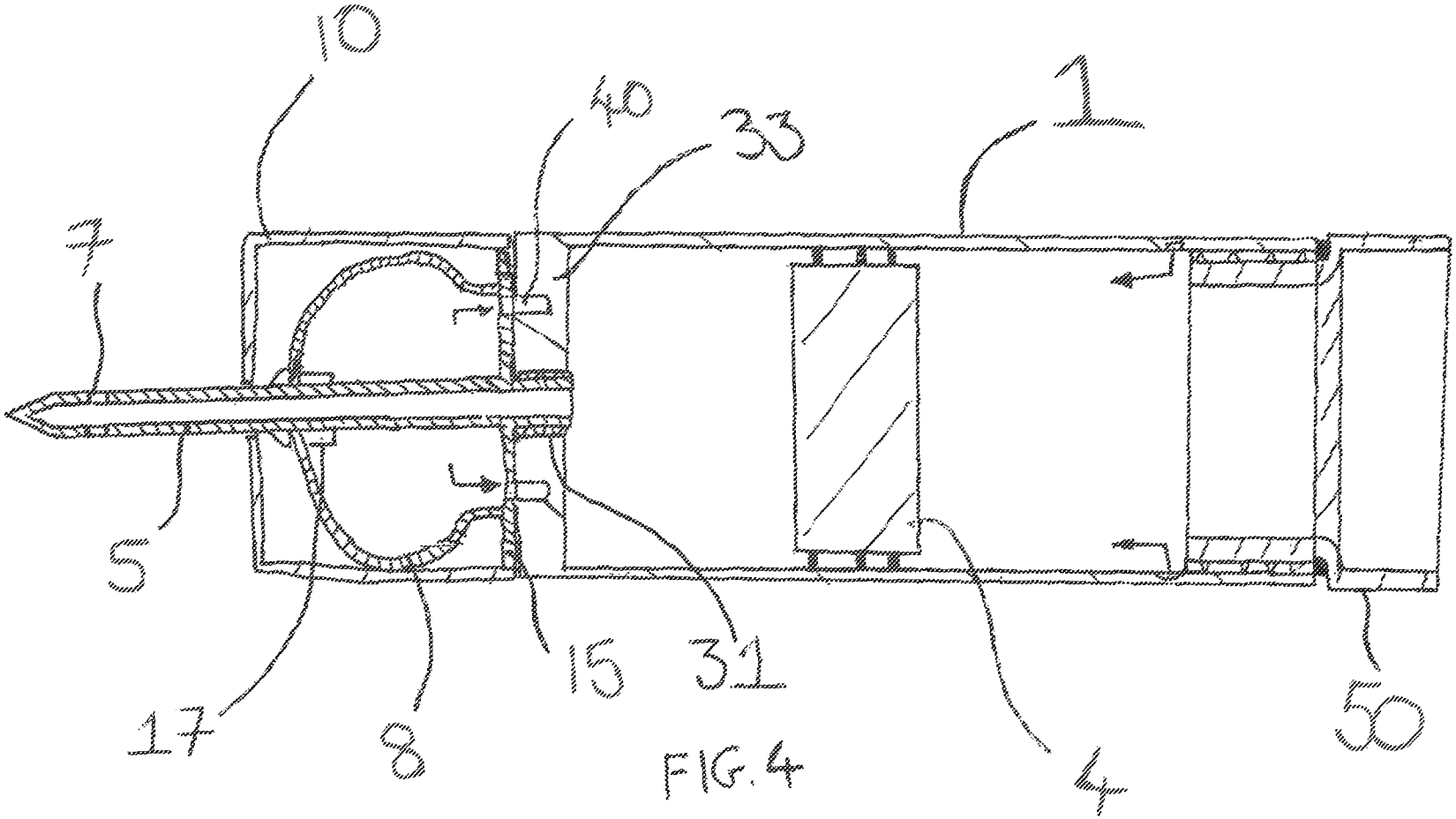
FIG. 4 is a cross-sectional side view of an alternative embodiment of the projectile.
Figure 5:
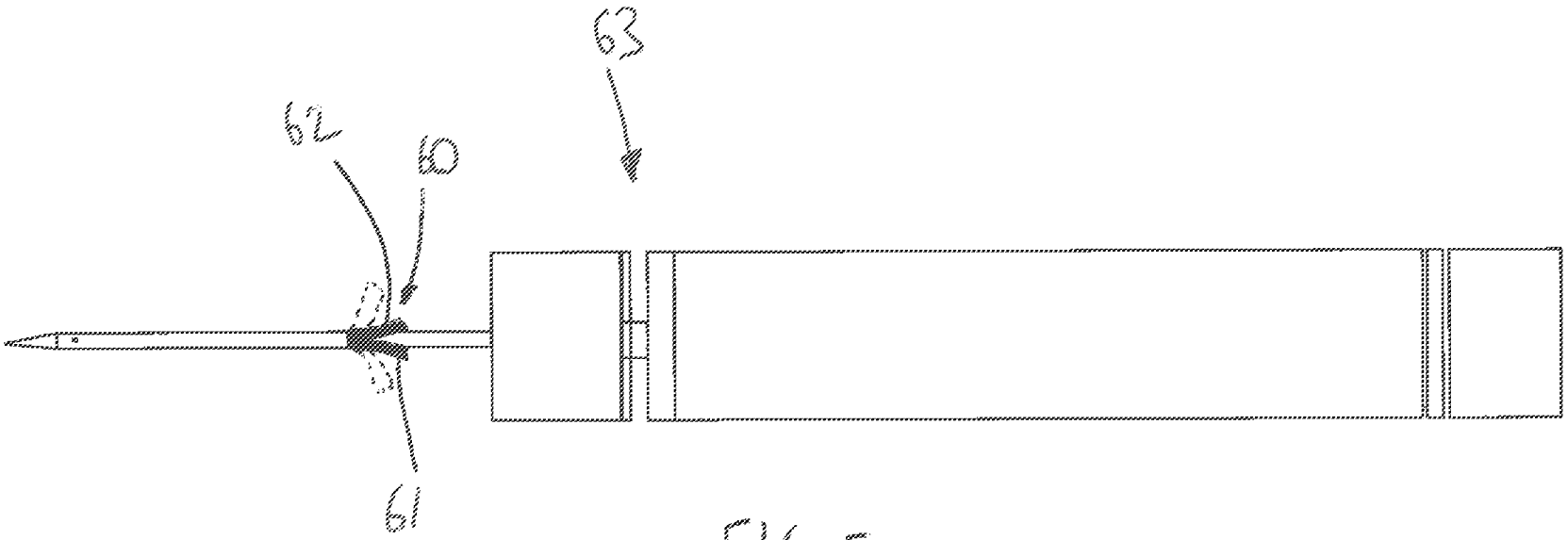
FIG. 5 shows a side view of further embodiment of the invention.

In an alternative advantageous embodiment, shown in FIG. 4, the rear part of the cavity 2 is connected to the inflatable bag 8 through channels 40. In this alternative embodiment, the cavity 2 behind piston 4 is charged with a pressurised gas for both inflating the bag 8 and ejecting the payload substance by forcing the piston 4 forwards. This gas may be derived from propulsion gases formed on firing the projectile. This arrangement avoids the need for the projectile itself to contain a gas producing charge.

The gas is released to inflate the bag 8 on impact with the target. In this embodiment, the release of gas pressure also acts to drive the piston 4 forward to deliver the payload through the needle 5. The channels 40 ensure the compartment 2 is connected with the bag 8 at a location behind the piston 4 in order to force the piston 4 forwards within the outer casing 1. There may be a pressurised gas compartment or capsule rather than an explosive gas producing compound.

As shown in FIG. 4, the projectile is in many respects similar to that of FIG. 1 and includes channels 40 to connect the compartment 2 to the bag 8. Details are otherwise similar to FIGS. 1 to 3 whereby the projectile has a casing 1 surrounding a compartment 2 to contain the substance to be ejected through the needle 5 and a piston 4 which serves to drive the substance in the cavity 2 forward and out through the needle 5.

The bag 8 may be inflated through a detonator 17 and gas producing explosive charge or through use of stored gas pressure. This charge or stored pressure may also serve for the purpose of dissipating the marker by driving a piston in the containing cavity.

The nose part of the projectile may include a solid foam-like or gel-like substance such as Aerogel forming an energy absorbing material which spreads on impact. This may be included surrounding the bag of gaseous medium 8 and contained within the cap 10.

The propellant charge for the projectile may be included within an integral cartridge casing forming a single piece round. The projectile may be a single use device pre-loaded with a defined marker and charge with different charges being coded for ease of field use. The casing may comprise a carbon fibre material or glass bonded hydrocarbon matrix.

The projectile may be packaged in such a way that arming only occurs when removed from the pack. The projectile has a particular use for soft targets which presently require firing at a close range of typically 20 m.

In a further alternative embodiment, the needle 5 itself may be dissolvable sub-cutaneously or intra-muscularly and itself contains the substance to be delivered to the animal including anaesthetic. In this embodiment, there is no need for the inner compartment 2 or piston 4 as the substance will be delivered as soon as the needle 5 is inserted into the animal and begins to dissolve and release the substance. This embodiment also is beneficial as there is no need for a liquid solution to be within the projectile which can act to decrease the stability of the flight.

The projectile has an inherently stable ballistic shape and may have a mass of about 10 to 150 grams and be some 10 to 50 mm in calibre. Larger or smaller calibre may be used as appropriate to the circumstances. The projectile may be embraced by a discarding sabot of plastics material and may be fired from a standard or progressive pitch rifled barrel giving a muzzle velocity of about 500 m/s. The range under these conditions should be of the order of 150 m with a mid-range trajectory fall of less than 20 cm.

In an alternative embodiment, the shape of the bag 8 is maintained and supported by a viscous filler which may be provided between the cap and the bag. The viscous filler may be of Aerogel (a Trade Mark). A valve may be provided between the payload container and the needle which may open on impact.

A detonator unit may be provided in the bag.

As described the pressure gas for inflating the bag 8 may be derived from either an inertia detonator with gas producing charge, from gas stored in the container or from the gases produced from the propulsive charge on firing using ports at the base which are exposed to the propulsive gases with intervening valve means to retain the gas pressure.

In another option the inertia detonator will initiate filling of the rear cavity 50 with pressurised gas on firing and this pressure is retained during flight. In another alternative a pressurised capsule may be incorporated to replace the inertia detonator.

A marker dye could be included between the nose cap 10 and the bag 8. Alternatively, the anaesthetic could be included in this spacing to enable it to reach the animal and act to reduce pain whilst the needle 5 is inserted.

In a modification excess gas pressure is used to further retard the projectile by forward facing discharge nozzles. The propellant charge for the projectile may be included within an integral cartridge casing forming a single piece round. The projectile may be a single use device pre-loaded with a defined marker and charge with different charges being coded for ease of field use. The casing may comprise a carbon fibre material or glass bonded hydrocarbon matrix.

The projectile may be integrated with a propellant charge carrying casing or caseless.

It will be appreciated that the sequence of events occurs rapidly in relation to the velocity of the projectile. The balloon-like inflation of the bag 8 also has the effect of pushing the projectile back relative to the target thus adding to the blow inflicted on the target.

In an alternative embodiment the bag 8 may comprise an expandable rubber material which stretches or the material may comprise KEVLAR (a registered Trade Mark) which initially inflates, then expands and finally allows gas pressure to bleed due to opening-up of the weave. In all embodiments a pressure relief system may be included to avoid over extending the inflation of the membrane.

In a further embodiment, one or more of the preceding projectiles such as projectile 63 may incorporate a cuff 60 with one or more laterally extending members 61 and 62 for retaining the needle in the target. The cuff's laterally extending members may initially be provided along the length of the needle and after impact project laterally as shown in dashed lines in order to better retain the needle in the target. Advantageously, the cuff may be dissolvable sub-cutaneously or intra-muscularly.

A number of components (eg. the needle, the payload) have been described as dissolvable sub-cutaneously or intramuscularly. Preferably, this signifies in certain embodiments that at least 80% of the material implanted is no longer an integral part of the component after 1 month when in the tissue. Preferably, at least 90% of the material implanted is no longer present as an integral part of the component after 1 month when in the tissue under conventional living conditions.

In a further alternative embodiment, the bag is filled with gas and the heat produced by the compression of the gas (eg. air) is used to ignite a fuel source on impact with the target. Alternatively, a detonator is used to enable the air bag to expand in flight. This expansion may be made to cause hinged electrical probes to extend down the length of the projectile's body. Alternatively, a capsule of diesel gas or equivalent can be contained within the airbag and the capsule may rupture at launch or on impact to expand the bag.

Moreover, in a further alternative embodiment, the gas pressure within the air bag is made to push the piston 4 down to the base of the projectile where injection ports may be located. In this embodiment, the payload is forced into the base of the needle to be injected forward providing a weightlessness as both the plunger and payload move away from the target on impact.

In a further alternative embodiment, the inner gas may be bled during the flight of the projection to decrease the amount of drag and provide a flatter trajectory.

In a further subsidiary aspect, the needle is made of relatively soft material.

Figure 6:
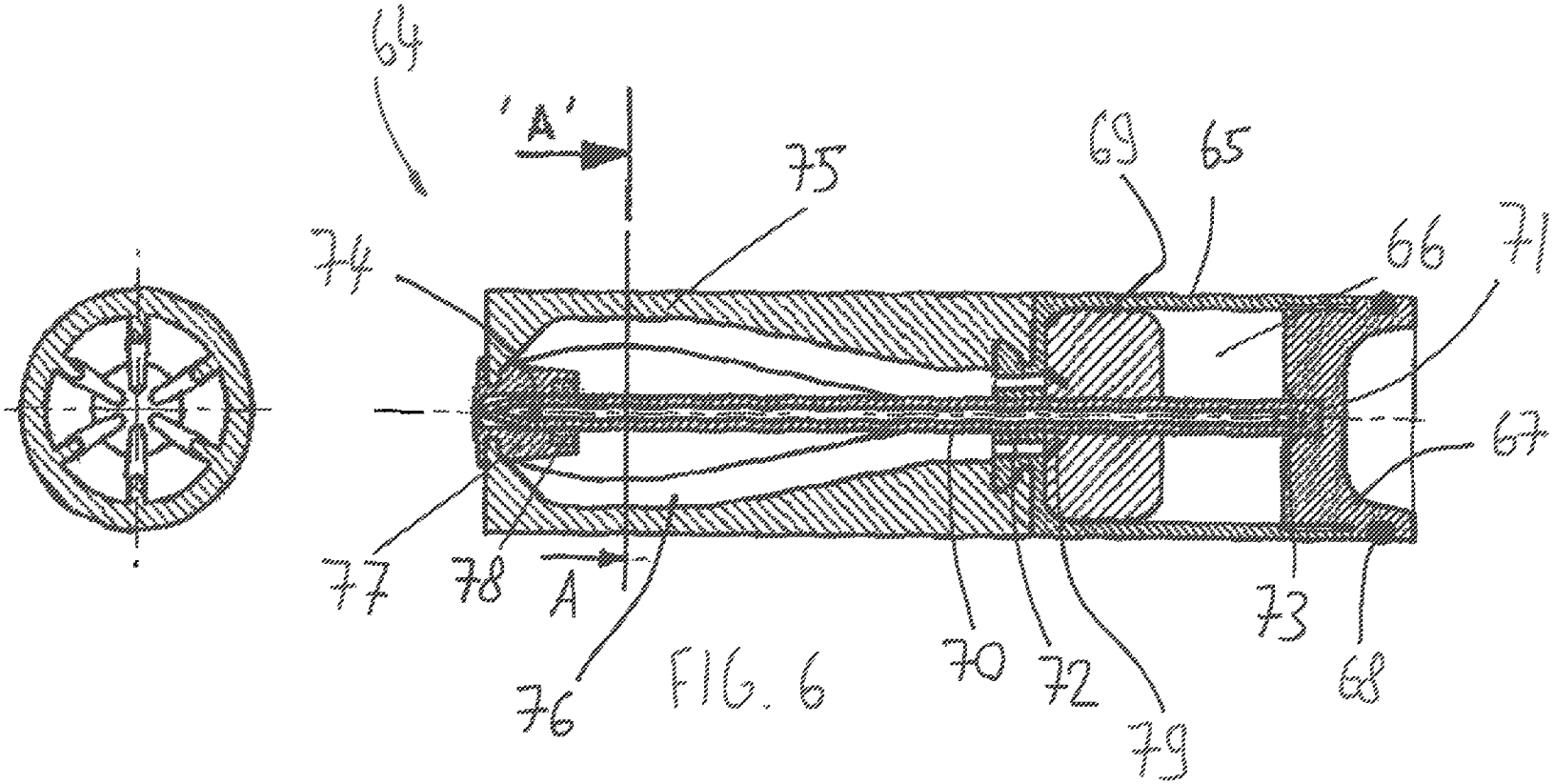
FIG. 6 shows a cross-sectional view along the length of a further embodiment of a projectile and a cross-sectional view along axis A-A.

FIG. 6 shows a projectile generally referenced 64 which incorporates a casing 65 containing a payload 66. Casing 65 is closed by an end cap 67 which is threaded into the rear-most portion of casing 65. An O-ring 68 seals off the end of the threaded portion to prevent any payload escaping between casing 65 and end cap 67. A plunger 69 is shown in its forward-most position prior to impact. A needle 70 is provided along the central axis of the projectile and rests in a recessed portion 71 in the end cap 67. The needle 70 is further secured through a central bore 72 in the front portion of the casing 65. Needle 70 has a central conduit between a payload inlet 73 and a payload outlet 74. A cap 75 provides an outer cylindrical surface which matches the diameter of casing 65 in order to provide the projectile with advantageous aerodynamic properties. Cap 75 surrounds an airbag 76. Furthermore, an impact detonator 77 partly surrounds the front most portion of the needle and is secured at least for the purposes of flight by a needle seal 78. On impact the detonator inflates the airbag as the needle penetrates the target and the cap 75 shatters. As a consequence of the pressure due to detonation arising in the airbag, it causes its expansion and the deformation leads to a one-way valve 79 opening up in the or each duct between the airbag cavity and the piston 69. Consequently, the piston travels towards the rear portion thus causing the payload to flow through inlet 73 to outlet 74. In this embodiment, the width of the cap between inner and outer diameter may vary to precisely correspond to the shape and configuration of the airbag. This configuration may still provide for the shatterable properties of the cap. The material used for the cap may for example be particularly brittle and moulded around the complex shape of the airbag as can be best seen in the cross-sectional view along axes A-A. The airbag in this configuration may effectively be potted into a brittle polymeric compound which may readily fracture on impact as opposed to the much more ductile casing 65.

Figure 7:
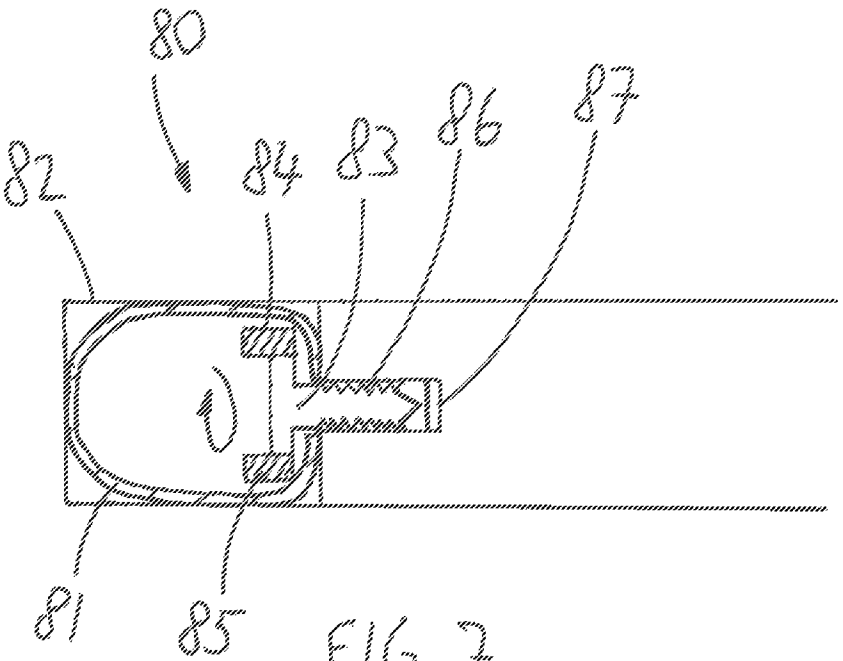
FIG. 7 shows a further embodiment of a projectile in schematic cross-sectional view along at least part of its length.

FIG. 7 shows a further embodiment of a projectile generally referenced 80 where a baton round is associated with an airbag 81 and a ballistic cap 82. Both of these components may be of the kind described with respect to other embodiments. In addition, a variable detonation mechanism is envisaged in the form of a rod 83 with diametrically oppositely located weights 84 and 85 which facilitate the rotation of rod 83. Dependent upon the motion of the rotation of rod 83 it engages with a threaded portion 86 which achieves the variable point of detonation. The active material of the detonator may be provided in portion 87. In a preferred embodiment, the active material will cause the expansion of the airbag upon detonation. The weighted portions 84 and 85 may be a weighted toggle which unwinds contra-wise to the rifled spin which can neutralise the detonation at a given range. In preferred embodiments, at certain ranges such as at close range, the weighted toggle or anvil rod fires the detonator to expand the airbag.

Figure 8:
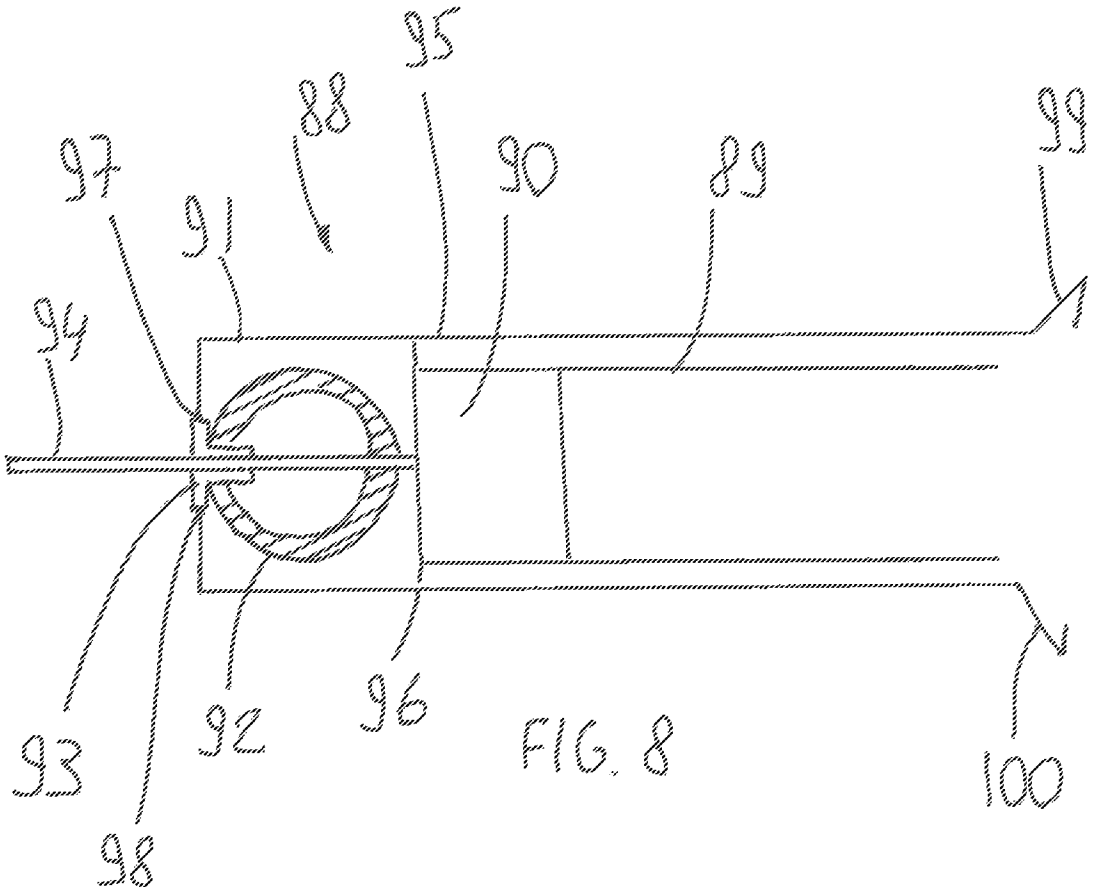
FIG. 8 shows a further embodiment of a projectile in schematic cross-sectional view along at least part of its length.

In a further embodiment, FIG. 8 shows a projectile generally referenced 88 with a casing 89. Instead of the payload of the previous embodiments or in addition to the payload of the previous embodiments, the casing comprises means for electrical sudden discharge which may be in the form of a capacitor 90. As with previous embodiments, a forward most portion incorporates a ballistic cap 91 surrounding an airbag 92. An expansion detonator 93 may be provided so that on impact the airbag inflates as described in previous embodiments. A rod 94 may be provided instead of a syringe which may act as a locator for the detonator and a support mechanism for other components of the projectile. In particular, a hinge may be provided between detonator 93 and an electrical probe such as probes 95 and 96. The hinges may be referenced 97 and 98 respectively. The electrical probes may be provided during flight mode against the outside surface of the casing. These may be sufficiently thin not to interfere with the aerodynamics of the projectile and may as appropriate be slightly recessed into the projectile's wall. Optionally, the electrical probes may incorporate at their distal extremities barbed ends 99 and 100. These may be pointed in order to plant into or firmly contact with a target.

Figure 9:
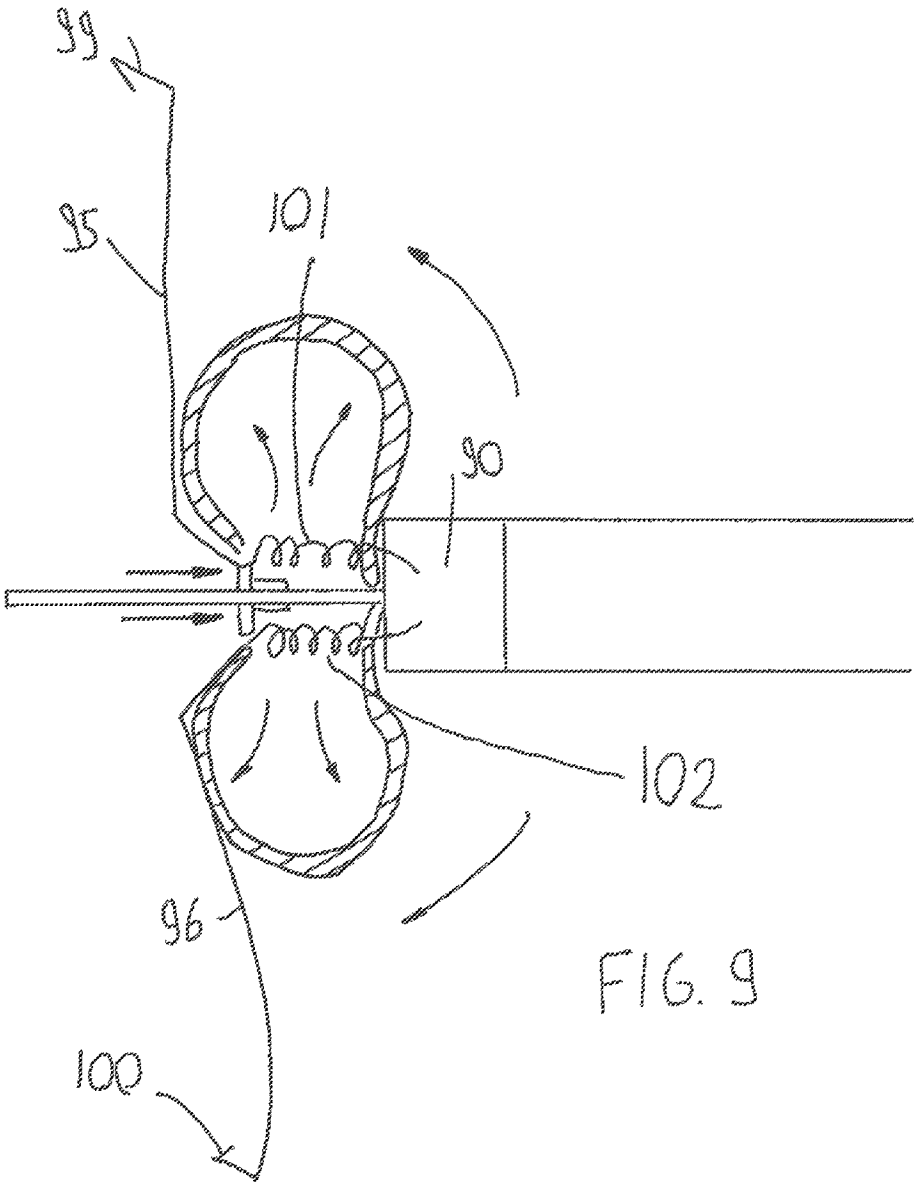
FIG. 9 shows an alternative configuration of the projectile of the embodiment of FIG. 8 in a schematic cross-sectional view along at least part of its length.

Whilst FIG. 8 shows the projectile body in-flight, FIG. 9 shows the projectile on impact during its deployment. As can be seen on impact, the ballistic cap is no longer visible since it will have shattered. On impact, the detonator 93 will have caused the expansion of the airbag or bag particularly in the lateral direction in order to increase the area of impact. As a consequence of the expansion of the bag, the electrical probes rotate by approximately 90 degrees in order to provide spaced apart points of impact. The spaced apart points may be the barbed distal extremities. The projectile also contains a capacitor 90 which is in electrical connection with the electrical probes via appropriate windings such as windings 101 and 102. This allows on impact the discharge of electrical current whilst at the same time providing extra protection from penetration of the projectile into a target by employing the bag.

The invention claimed is:

1. A projectile comprising a bag of gaseous medium to effectively retard the velocity thereof on impact with a target in such a way as to prevent excess damage, injury or penetration, said projectile having a forward-facing nose portion and a rear-facing portion wherein said bag is configured to increase in area at the nose portion of the projectile following impact with a target, wherein said projectile comprises a needle for penetrating a target and a cap which encloses said bag; wherein said cap comprises a cylindrical side wall which is disposed radially outwards from said bag, a single central aperture through which said needle extends, and a substantially flat forward-facing surface extending from said cylindrical side wall to said single central aperture.

2. The projectile according to claim 1, wherein said cap is formed of a single piece of readily shatterable plastics material.

3. The projectile according to claim 1, wherein said bag is substantially spherical before impact with a target.

4. The projectile according to claim 1, further comprising a casing which contains a payload; said needle defining a channel for said payload to exit said casing;

said needle being releasably mounted to said casing.

5. The projectile according to claim 4, wherein said casing has a forward-facing surface; said needle incorporating a disc which sits against said forward-facing surface of said casing when said needle is attached to said casing.

6. The projectile according to claim 5, wherein said cap is secured with an interference fit to the perimeter of said disc.

7. The projectile according to claim 5, wherein said bag is secured between said disc and a retention cuff.

8. The projectile according to claim 1, wherein said needle comprises a conical tip which has itself no aperture.

9. The projectile according to claim 1, wherein said needle comprises one or more lateral apertures.

10. The projectile according to claim 1, wherein said needle protrudes beyond said cap to a length greater than the length of the cap.

11. The projectile according to claim 1, wherein said needle comprises a cuff with one or more laterally extending members for retaining said needle in said target.

12. The projectile according to claim 11, wherein said cuff is dissolvable sub-cutaneously or intra-muscularly.

13. The projectile according to claim 1, wherein said bag forms a cavity which contains air; wherein said air is substantially retained in said cavity after impact.

14. The projectile according to claim 1, wherein said bag is configured to expand following impact with a target.

15. The projectile according to claim 1, wherein said expansion is effected by means of a pressurised medium stored in the projectile.

16. The projectile according to claim 14, wherein a duct is provided between said bag and a cylinder of said casing; whereby pressurised gas applies pressure onto a piston in order to assist in the delivery of a payload.

17. The projectile according to claim 1, further comprising a compound which includes an anaesthetic composition.

18. The projectile according to claim 17, wherein said anaesthetic composition is provided between said cap and said bag.

19. The projectile according to claim 1, wherein said needle is dissolvable sub-cutaneously or intra-muscularly.

20. The projectile according to claim 1, wherein said needle contains a payload.

21. The projectile according to claim 1, wherein said bag comprises a rod which is displaceable by a threaded engagement towards a detonator dependent upon the extent of rotation which the projectile undergoes during rifling spin.

22. The projectile according to claim 21, wherein said rod unwinds in the direction opposite to the rifling spin.

23. The projectile according to claim 21, wherein said rod unwinds in the direction of the rifling spin.

24. The projectile according to claim 21, wherein said rod is attached to two weighted portions which are separated in the lateral direction by a spacing.

25. The projectile according to claim 1, wherein said projectile comprises a storage of electrical charge and one or more electrical probes which are configured to discharge said charge in said target.

26. The projectile according to claim 25, wherein said electrical probes are secured to the outside wall of said projectile during flight and said bag causes said electrical probes to displace towards said target on impact.

27. The projectile according to claim 25, further comprising a shaft which secures an impact detonator in a forward position.

28. The projectile according to claim 25, further comprising a casing and one or more conductors extending between a capacitor located in the casing of the projectile and said electrical probes.

29. The projectile according to claim 25, wherein said electrical probes comprise a distal extremity which is barbed.

* * * * *